US009732544B2

(12) United States Patent
Wittelsbuerger et al.

(10) Patent No.: US 9,732,544 B2
(45) Date of Patent: Aug. 15, 2017

(54) MOTOR VEHICLE LOCK

(71) Applicant: Brose Schliesssysteme GmbH & Co. KG, Wuppertal (DE)

(72) Inventors: Michael Wittelsbuerger, Lake Orion, MI (US); David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 13/929,193

(22) Filed: Jun. 27, 2013

(65) Prior Publication Data

US 2014/0284939 A1 Sep. 25, 2014

Related U.S. Application Data

(60) Provisional application No. 61/804,909, filed on Mar. 25, 2013.

(51) Int. Cl.
*E05C 3/06* (2006.01)
*E05B 77/06* (2014.01)

(52) U.S. Cl.
CPC ..... *E05B 77/06* (2013.01); *Y10S 292/22* (2013.01); *Y10T 292/0908* (2015.04); *Y10T 292/0926* (2015.04); *Y10T 292/0949* (2015.04)

(58) Field of Classification Search
CPC ..... E05B 77/06; Y10T 292/0908; Y10T 292/0926; Y10T 292/0949; Y10S 292/22
(Continued)

(56) References Cited

U.S. PATENT DOCUMENTS 703,962 A 7/1902 John et al.
846,129 A 3/1907 Clyde et al.
(Continued)

FOREIGN PATENT DOCUMENTS

DE 19511651 10/1995
DE 10337392 3/2005
(Continued)

OTHER PUBLICATIONS

"German Search Report," for DE application No. 102014104120.8 dated Mar. 13, 2015 (5 pages).
(Continued)

*Primary Examiner* — Kristina Fulton
*Assistant Examiner* — Christine M Mills
(74) *Attorney, Agent, or Firm* — Pauly, DeVries Smith & Deffner, LLC

(57) ABSTRACT

The invention relates to a lock for a door, comprising a catch and a pawl. The catch can be in an open or closed position. The catch may be brought into holding engagement with a lock striker. The pawl may be brought into an engagement position. The pawl may be deflected into a release position, to release the catch. A pawl actuation lever can deflect the pawl into the release position. A switchable coupling arrangement is provided between the pawl actuation lever and the pawl. The switchable coupling arrangement may be brought into a closing and an opening state. When the actuation movement of the pawl actuation lever surpasses a threshold, an inertial characteristic of the lock causes the switchable coupling arrangement to switch into the opening state such that the pawl actuation lever runs without deflecting the pawl into its release state.

12 Claims, 3 Drawing Sheets

(58) Field of Classification Search
USPC ..... 292/92, 336.3, 216, DIG. 22, DIG. 23, 292/DIG. 65
See application file for complete search history.

(56) References Cited

U.S. PATENT DOCUMENTS

| | | | | |
|---|---|---|---|---|
| 2,793,898 | A | 5/1957 | Roethel et al. | |
| 2,832,626 | A | 4/1958 | Priestman et al. | |
| 3,848,909 | A | 11/1974 | Foley et al. | |
| 4,441,345 | A | 4/1984 | Guarr | |
| 4,911,489 | A | 3/1990 | Hansen et al. | |
| 5,183,300 | A | 2/1993 | Schrader et al. | |
| 5,865,481 | A | 2/1999 | Buschmann | |
| 5,967,572 | A | 10/1999 | Sajfert et al. | |
| 6,308,998 | B1 | 10/2001 | Armbruster et al. | |
| 6,471,259 | B1 | 10/2002 | Erices et al. | |
| 6,543,820 | B2 | 4/2003 | Kelly et al. | |
| 6,971,688 | B2 | 12/2005 | Drysdale et al. | |
| 7,175,211 | B2 | 2/2007 | Cetnar et al. | |
| 7,198,307 | B2 * | 4/2007 | Drysdale et al. | 292/216 |
| 7,325,874 | B2 | 2/2008 | Zhang et al. | |
| 7,607,702 | B2 | 10/2009 | Pereverzev | |
| 7,703,828 | B2 | 4/2010 | O'connor et al. | |
| 7,926,858 | B2 | 4/2011 | Otsuka | |
| 8,056,944 | B2 | 11/2011 | Jankowski et al. | |
| 8,303,004 | B2 | 11/2012 | Lee et al. | |
| 8,727,398 | B2 | 5/2014 | Brose et al. | |
| 8,727,443 | B2 | 5/2014 | Vedder et al. | |
| 8,967,678 | B2 | 3/2015 | Rosales et al. | |
| 9,074,393 | B2 | 7/2015 | Brose et al. | |
| 9,109,380 | B2 | 8/2015 | Mittelbach et al. | |
| 9,366,063 | B2 | 6/2016 | Rosales et al. | |
| 9,376,842 | B2 | 6/2016 | Wittelsbuerger et al. | |
| 2006/0267351 | A1 | 11/2006 | Spurr | |
| 2009/0322105 | A1 * | 12/2009 | Lee et al. | 292/237 |
| 2010/0237633 | A1 * | 9/2010 | Jankowski et al. | 292/216 |
| 2010/0283268 | A1 * | 11/2010 | Cumbo | 292/196 |
| 2011/0084505 | A1 | 4/2011 | Brose et al. | |
| 2011/0181052 | A1 | 7/2011 | Brose et al. | |
| 2011/0252844 | A1 | 10/2011 | Shoemaker | |
| 2011/0254343 | A1 | 10/2011 | Vedder et al. | |
| 2013/0129413 | A1 | 5/2013 | Dryburgh et al. | |
| 2013/0147209 | A1 | 6/2013 | Lee et al. | |
| 2013/0147211 | A1 | 6/2013 | Lee et al. | |
| 2013/0313036 | A1 | 11/2013 | Kovie | |
| 2013/0328325 | A1 | 12/2013 | Uehara et al. | |
| 2014/0097624 | A1 * | 4/2014 | Papanikolaou | E05B 77/06 292/202 |
| 2014/0132008 | A1 | 5/2014 | Bendel et al. | |
| 2014/0284942 | A1 | 9/2014 | Wittelsbuerger et al. | |
| 2014/0284943 | A1 | 9/2014 | Wittelsbuerger et al. | |
| 2014/0284944 | A1 | 9/2014 | Rosales et al. | |
| 2014/0284945 | A1 | 9/2014 | Wittelsbuerger et al. | |
| 2014/0346786 | A1 | 11/2014 | Takagi et al. | |
| 2015/0061301 | A1 | 3/2015 | Torka et al. | |
| 2015/0115628 | A1 | 4/2015 | Wittelsbuerger et al. | |
| 2016/0090759 | A1 | 3/2016 | Rosales et al. | |

FOREIGN PATENT DOCUMENTS

| | | | | |
|---|---|---|---|---|
| DE | EP 1518983 | A2 * | 3/2005 | E05B 77/06 |
| DE | 102004014550 | | 10/2005 | |
| DE | 202009009061 | U1 * | 12/2010 | E05B 77/06 |
| DE | 202009009060 | | 1/2011 | |
| DE | 202009009061 | | 1/2011 | |
| DE | 112010004028 | | 1/2013 | |
| EP | 1018589 | | 7/2000 | |
| WO | WO 2011010554 | A1 * | 1/2011 | |
| WO | 2012055387 | | 5/2012 | |
| WO | 2012119580 | | 9/2012 | |

OTHER PUBLICATIONS

Amendment and Response filed, Jan. 11, 2016, 8 pages.
Final Office Action for U.S. Appl. No. 13/929,258 dated Nov. 27, 2015 (14 pages).
Final Office Action for U.S. Appl. No. 14/871,601 dated Oct. 11, 2016 (18 pages).
Final Office Action or U.S. Appl. No. 14/065,124 dated Sep. 29, 2016 (10 pages).
German Search Report for DE 10 2014 104 111.9, dated Dec. 1, 2014 (7 pages).
Non Final Office Action for U.S. Appl. No. 14/065,124, dated Feb. 19, 2016 (10 pages).
Non-Final Office Action for U.S. Appl. No. 13/929,258, dated Mar. 27, 2015 (17 pages).
Non-Final Office Action for U.S. Appl. No. 13/929,265 dated Aug. 10, 2015 (8 pages).
Non-Final Office Action for U.S. Appl. No. 13/941,254 dated Mar. 7, 2017 (16 pages).
Non-Final Office Action for U.S. Appl. No. 13/941,254, dated Jun. 10, 2016 (16 pages).
Non-Final Office Action for U.S. Appl. No. 14/871,601, dated May 20, 2016 (20 pages).
Non-Final Office Action for U.S. Appl. No. 13/929,278, dated Mar. 31, 2015 (22 pages).
Notice of Allowance for U.S. Appl. No. 13/929,265, dated Mar. 31, 2016 (10 pages).
Notice of Allowance for U.S. Appl. No. 13/929,278 dated Mar. 10, 2016 (11 pages).
Notice of Allowance for U.S. Appl. No. 13/929,278 dated Nov. 2, 2015 (11 pages).
Restriction Requirement for U.S. Appl. No. 13/941,254 dated Oct. 8, 2015 (5 pages).
Search Report for German Patent Application No. 102014104118.6 related to U.S. Appl. No. 13/929,258, dated Dec. 9, 2014 (7 pages).
Takagi, et al., "Vehicle Door Lock," from WO2011010554, Takagi et al., with English translation. Translated on Mar. 23, 2015 (15 pages).

* cited by examiner

MOTOR VEHICLE LOCK

CLAIM OF PRIORITY

This application claims the benefit of priority, under 35 U.S.C. Section 119(2), to U.S. Provisional Application No. 61/804,909, filed Mar. 25, 2013, which is hereby incorporated by reference herein in its entirety.

FIELD OF THE INVENTION

The invention is directed to a motor vehicle lock for a motor vehicle door arrangement.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The crash safety plays an important role for today's motor vehicle locks. It is of particular importance that neither crash induced acceleration nor crash induced deformation leads to an unintended opening of the motor vehicle door which the motor vehicle lock is assigned to. The focus of the present application is to prevent an unintended opening of the motor vehicle door based on crash induced acceleration. In case of a side impact on the motor vehicle the outer door handle may be reluctant to follow the impact due to mass inertia of the outer door handle. As a result a relative movement between the outer door handle and the motor vehicle door occurs, which again may lead to an unintended opening of the motor vehicle door.

The known motor vehicle lock (US 2011/0181052A2), which is the starting point for the invention, is provided with the usual locking elements catch and pawl, wherein the pawl may be deflected into a release position by actuation of a pawl actuation lever.

The known motor vehicle lock also comprises a lock mechanism which may be brought into different functional states such as "unlocked" and "locked" by the user. The pawl may be deflected into its release position by an outer door handle, which is connected to the pawl actuation lever, if the lock mechanism is in its unlocked state. With its lock mechanism being in its locked state an actuation of the pawl actuation lever runs free.

To guarantee a high crash safety the known motor vehicle lock comprises a crash element which is a separate component from the pawl actuation lever. By the accelerations which occur during a crash the crash element moves into a blocking position in which the crash element blocks further actuation of the pawl actuation lever.

One challenging aspect regarding the known motor vehicle lock is the constructional design of the drive train between the door handle and the pawl. This is true as in a crash situation the whole drive train starting from the door handle is being blocked. In order not to run the risk on an unpredictable brakeage of the drive train, this drive train has to be designed for exceptionally high forces, which leads to high material and production costs.

SUMMARY

It is the object of the invention to improve the known motor vehicle lock such that a cost effective constructional design is possible without reducing the resulting crash safety.

The above noted object is solved for a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement may be brought into a closing state and into an opening state, wherein when the actuation movement of the pawl actuation lever surpasses a rapidity threshold, in particular induced by a crash, an inertial characteristic of the motor vehicle lock causes the switchable coupling arrangement, if not already in the opening state, to switch into the opening state such that the pawl actuation lever runs free without deflecting the pawl into its release state.

The basic idea underlying the invention is to decouple the pawl actuation lever from the pawl by a switchable coupling arrangement in a crash. For this the inertial characteristic of the motor vehicle lock is utilized. When the actuation movement of the pawl actuation lever surpasses a rapidity threshold, which may be induced by a crash, the inertial characteristic of the motor vehicle lock causes the switchable coupling arrangement, if not already in the opening state, to switch into the opening state. As a result, during such a rapid actuation movement, in particular induced by a crash, the pawl actuation lever runs free without deflecting the pawl into the release state. Blocking of the drive train which is assigned to deflecting the pawl is not necessary in any case.

The proposed solution guarantees that a "normal" actuation movement of the pawl actuation lever does not affect the switchable coupling arrangement, such that the release of the pawl by this actuation movement is not affected as well. Only if the actuation movement of the pawl actuation lever surpasses the above noted rapidity threshold, the inertial characteristic of the motor vehicle lock causes the switchable coupling arrangement to switch in the above noted sense.

It is to be understood that the expression "rapidity threshold" is to be in a broad sense. This expression should make clear that making the actuation movement extensively quick leads to switching the switchable coupling arrangement into the opening state. According to this broad interpretation, it does not make a considerable difference if the acceleration, velocity or development of velocity is presently being discussed.

According to an embodiment the switchable coupling arrangement comprises a switching element which is in engaged or engageable with a coupling element of the switchable coupling arrangement. This allows a simple mechanical construction as the coupling functionality may be designed basically separately from the inertial based switching mechanism. In an example, it is preferably provided that the inertial characteristic of the switching element causes switching of the switchable coupling arrangement when the actuation movement of the pawl actuation lever surpasses the rapidity threshold.

A particularly robust construction is possible, if during normal, slow actuation of the pawl actuation lever the switching element is sliding along and supported by a support contour, which guarantees the switching element staying in its closing switching state. Once the actuation movement surpasses the rapidity threshold, preferably, the switching element leaves the support contour deflecting into the direction of its opening switching state. The switching element leaving the support contour may be supported by a steep change in direction of the support contour which, when the actuation movement surpasses the rapidity threshold, cannot be followed by the switching element due to its inertial characteristics. Here it becomes clear that providing an above noted support contour can lead to a particularly simple mechanical construction.

The further embodiment, the switching element, after leaving the support contour, during further actuation of the pawl actuation lever, comes onto engagement with a switching contour which engagement deflects the switching element into the opening switching state. This means that at least part of the actuation movement is being transformed into a deflecting movement of the switching element via the switching contour. Insofar the switching contour serves as a gear arrangement converting the actuation movement of the pawl actuation lever into a deflecting movement of the switching element.

A compact construction may be achieved with the a preferred embodiment which proposes to use the switchable coupling arrangement to bring the lock mechanism into different functional states such as "unlocked" and "locked". With this additional idea the switchable coupling arrangement not only has a crash safety function, but also a locking/unlocking function.

In an embodiment, the invention provides a motor vehicle lock for a motor vehicle door arrangement, wherein a catch and a pawl, which is assigned to the catch, are provided, wherein the catch can be brought into an open position and into a closed position, wherein the catch, which is in the closed position, is or may be brought into holding engagement with a lock striker, wherein the pawl may be brought into an engagement position, in which it is in blocking engagement with the catch wherein the pawl may be deflected into a release position, in which it releases the catch, wherein a pawl actuation lever is provided for deflecting the pawl into the release position, wherein a switchable coupling arrangement is provided between the pawl actuation lever and the pawl, wherein the switchable coupling arrangement may be brought into a closing state and into an opening state, wherein when the actuation movement of the pawl actuation lever surpasses a rapidity threshold, in particular induced by a crash, an inertial characteristic of the motor vehicle lock causes the switchable coupling arrangement, if not already in the opening state, to switch into the opening state such that the pawl actuation lever runs free without deflecting the pawl into its release state.

In one embodiment, the switchable coupling arrangement comprises a moveable switching element that may be moved into a closing switching state such that the switchable coupling arrangement is in the closing state and into an opening switching state such that the switchable coupling arrangement is in the opening state.

In one embodiment, the switchable coupling arrangement comprises a first coupling lever on the side of the pawl actuation lever, a second coupling lever on the side of the pawl and a moveable coupling element that may be moved into a closing state for coupling engagement with the two coupling levers and into an opening state for decoupling the two coupling levers.

In one embodiment, the switching element is engaged or engageable with the coupling element.

In one embodiment, the first coupling lever is the pawl actuation lever and that the second coupling lever is one of a pawl release lever connected to the pawl and the pawl.

In one embodiment, the switching element is arranged and moveable on one of the two coupling levers.

In one embodiment, the switching element is arranged and moveable on the pawl actuation lever.

In one embodiment, when the actuation movement of the pawl actuation lever surpasses the rapidity threshold an inertial characteristic of the switching element causes the switchable coupling arrangement, if not already in the opening state, to switch into the opening state such that the pawl actuation lever runs free without deflecting the pawl into its release state.

In one embodiment, starting off from the switching element being in the closing switching state an inertial characteristic of the switching element causes a switching movement of the switching element into the opening switching state when the actuation movement surpasses the rapidity threshold.

In one embodiment, the switching element is sliding along and supported by a support contour such that the movement of the switching element during actuation of the pawl actuation lever below a rapidity threshold is defined by the support contour, holding the switching element in its closing switching state.

In one embodiment, the switching element is spring biased onto the support contour.

In one embodiment, when the actuation movement surpasses the rapidity threshold the switching element, caused by its inertial characteristic, leaves the support contour.

In one embodiment, when the actuation movement surpasses the rapidity threshold the switching element, caused by its inertial characteristics, comes into sliding engagement with a switching contour which engagement causes, during further actuation of the pawl actuation lever, deflecting the switching element further into the direction of its opening switching state.

In one embodiment, when the actuation movement surpasses the rapidity threshold the switching element, after leaving the support contour, during further actuation of the pawl actuation lever, comes into engagement with the switching contour which engagement deflects the switching element into the opening switching state.

In one embodiment, a lock mechanism is provided, which may be brought into different functional states such as "unlocked" and "locked" via a lock actuation arrangement and wherein the lock mechanism acts on the switchable coupling arrangement for realizing the functional states "unlocked" and "locked" such that in the functional state "unlocked" the switchable coupling arrangement closes and in the functional state "locked" opens.

BRIEF DESCRIPTION OF THE FIGURES

In the following the invention will be described in an example referring to the drawings. The drawings show.

DETAILED DESCRIPTION

Figure 1:
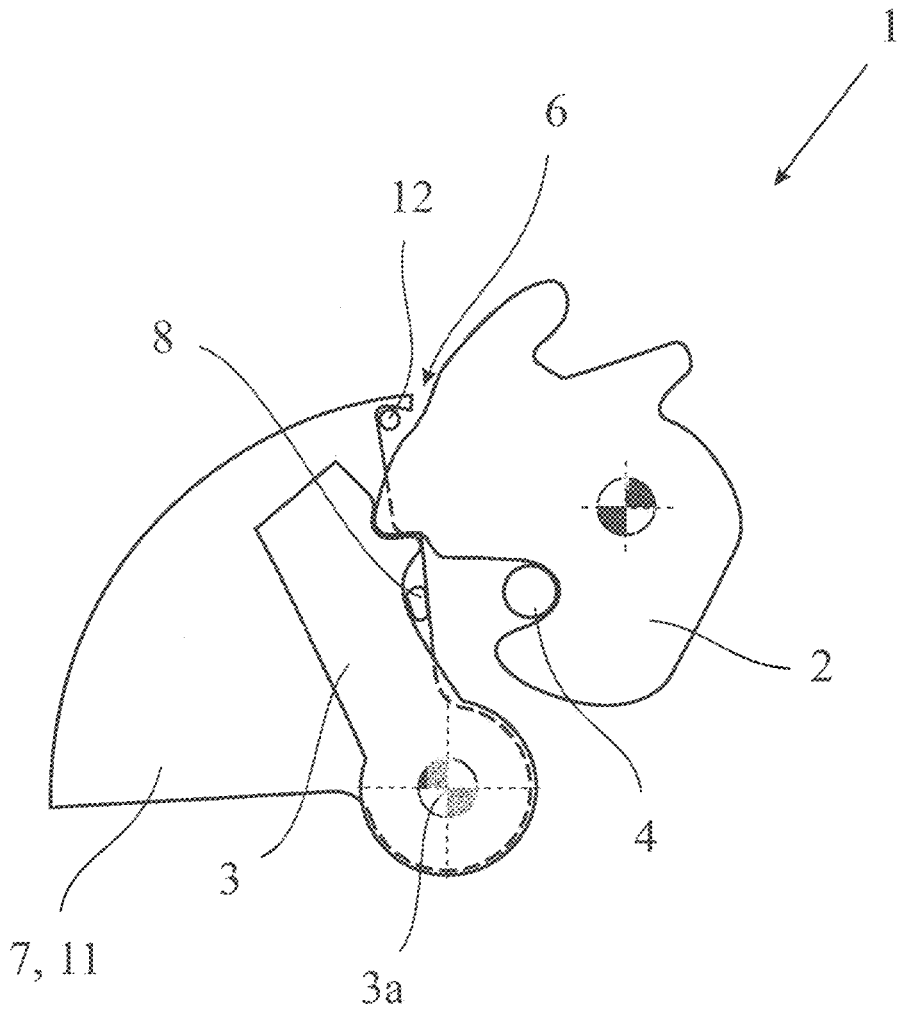
FIG. 1 selected parts of a proposed motor vehicle lock in a front side view, FIG. 2 selected parts of the motor vehicle lock according to FIG. 1 in a backside view a) in the non-actuated state, b) in a first actuated state during normal operation, c) in a subsequent second actuated state during normal operation, FIG. 3 the arrangement shown in FIG. 2 a) in a first actuated state induced by a crash, b) in a subsequent second actuated state induced by a crash, c) in a subsequent third actuated state induced by a crash.

The motor vehicle lock 1 shown in the drawings is assigned to a motor vehicle door arrangement, which comprises a motor vehicle door (not shown) besides said motor vehicle lock 1. Regarding the broad interpretation of the expression "motor vehicle door" reference is made to the introductory part of the specification. Here and preferably the motor vehicle door is a side door of the motor vehicle.

The motor vehicle lock 1 comprises the usual locking elements catch 2 and pawl 3, which catch 2 is assigned to the catch 2. The catch 2 can be brought into an open position (not shown) and into a closed position (FIG. 1). In the closed position shown in FIG. 1 the catch 2 is or may be brought into holding engagement witch a lock striker 4 that is indicated in FIG. 1 as well. The motor vehicle lock 1 is normally arranged at or in the motor vehicle door, while the lock striker 4 is arranged at the motor vehicle body.

The pawl 3 may be brought into an engagement position shown in FIG. 1, in which it is in blocking engagement with the catch 2. Here and preferably the pawl 3 blocks the catch 2 in its closed position in a mechanically stable manner such that the pawl 3 itself does not have to be blocked. For release of the catch 2 into its open position the pawl 3 may be deflected into a release position (not shown), which would be a deflection in the counter clockwise direction in FIG. 1.

Figure 2:
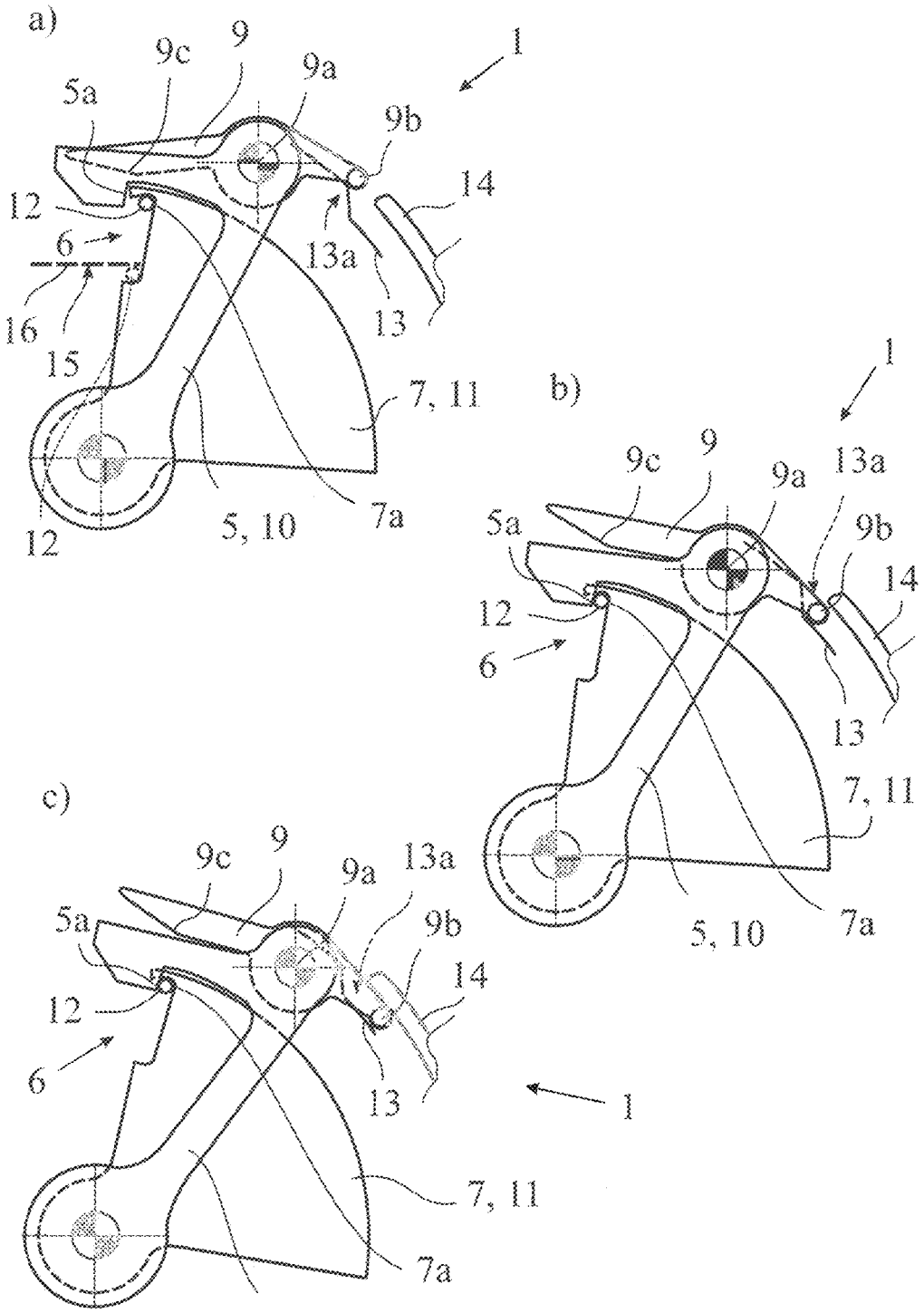
Figure 3:
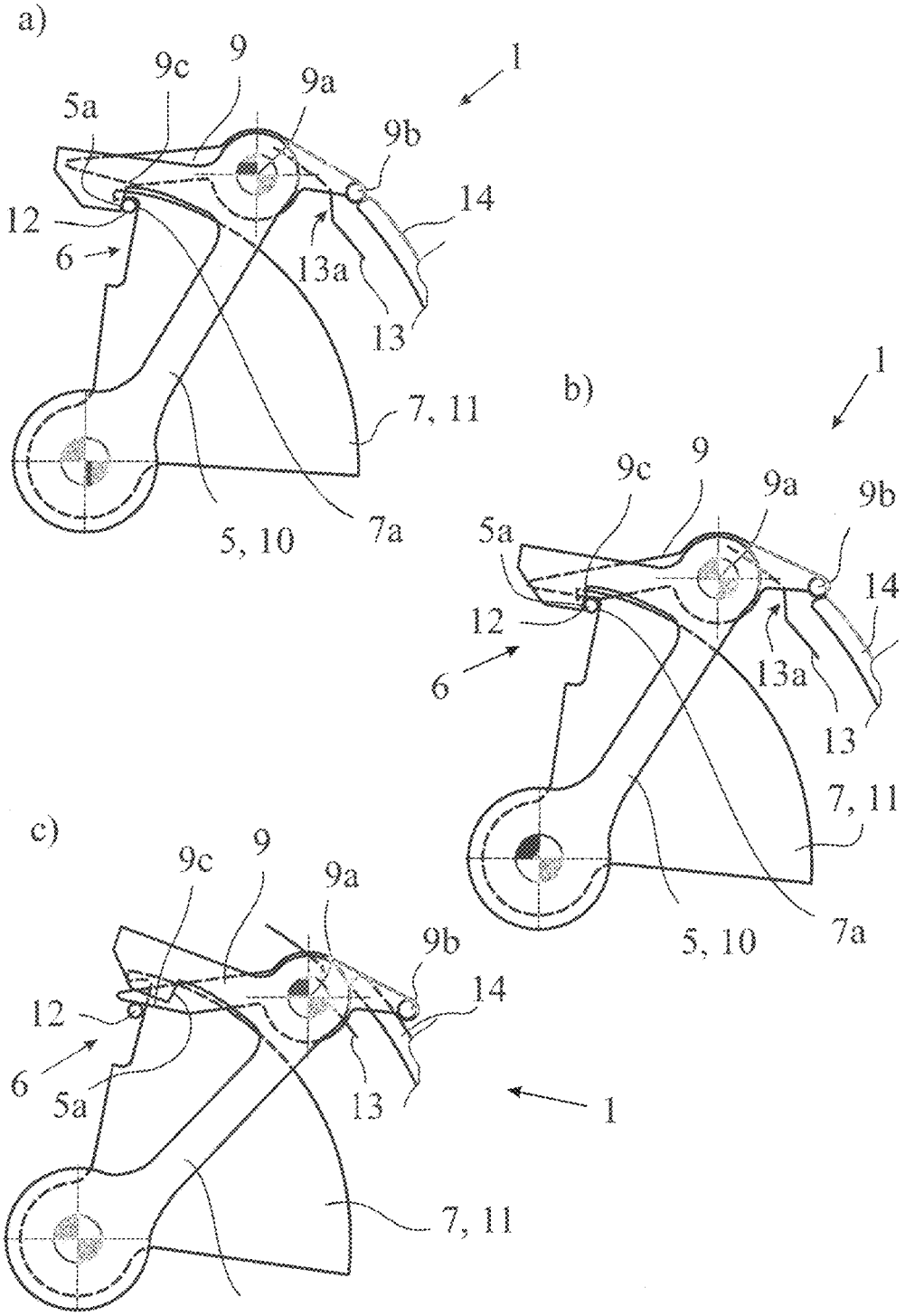

FIGS. 2 and 3 show that a pawl actuation lever 5 is provided for deflecting the pawl 3 into the release position. The pawl actuation lever 5 may be coupled to a door handle, preferably to an outer door handle, such that the assigned motor vehicle door may be opened by actuating the door handle. Alternatively or in addition the pawl actuation lever 5 may be actuatable by a motor drive.

Again, FIGS. 2 and 3 show that a switchable coupling arrangement 6 is provided between the pawl actuation lever 5 and the pawl 3, wherein the switchable coupling arrangement 6 may be brought into a closing state (FIG. 2*a-c*, FIG. 3*a,b*) and into an opening state (FIG. 3*c*). In the closing state the switchable coupling arrangement 6 provides a coupling function, whereas the switchable coupling arrangement 6 in its opening state provides a decoupling function.

Here and preferably, when the switchable coupling arrangement 6 is in the closing state, an actuation movement of the pawl actuation lever 5 leads to deflecting a pawl release lever 7 which deflection leads to a resulting deflection of the pawl 3 itself. It may be taken from FIG. 1, that the necessary coupling between the pawl release lever 7 and the pawl 3 is realized by a coupling pin 8. Generally the function of the pawl release lever 7 may be provided by the pawl 3 itself.

When the actuation movement of the pawl actuation lever 5 surpasses a rapidity threshold, which may in particular be induced by a crash, an inertial characteristic of the motor vehicle lock 1, which will be explained in further detail later, causes the switchable coupling arrangement 6, if not already in the opening state, to switch into the opening state such that the pawl actuation lever 5 runs free without deflecting the pawl 3 into its release state. This quick actuation movement is shown by the sequence of FIGS. 3*a, b* and *c*.

The switchable coupling arrangement 6 here and preferably comprises a movable switching element 9 that may be moved into a closing switching state (FIG. 3*a*) such that the switchable coupling arrangement 6 is in the closing state and into an opening switching state (FIG. 3*c*) such that the switchable coupling arrangement 6 is in the opening state.

Further preferably, the switchable coupling arrangement 6 comprises a first coupling lever 10 on the side of the pawl actuation lever 5, a second coupling lever 11 on the side of the pawl 3 and a movable coupling element 12 that may be moved into a closing state (FIG. 3*a, b*) for coupling engagement with the two coupling levers 10, 11 and into an opening state (FIG. 3*c*) for decoupling the two coupling levers 10, 11. In the shown and insofar preferred embodiment the first coupling lever 10 is the pawl actuation lever 5 and the second coupling lever 11 is the pawl release lever 7 connected to the pawl 3. Generally, the second coupling lever 11 may as well be the pawl 3 itself.

In the shown and insofar preferred embodiment the coupling element 12 is a wire or strip that in the drawings extends perpendicular with respect to the drawing plain. The coupling element 12 may be deflected between the closing state shown in FIG. 2*a* in solid line and the opening state shown in FIG. 3*c*. FIG. 2*a* also indicates the coupling element 12 in its opening state in dashed line. Here it becomes clear that a certain state of the coupling element 12 is assigned a hole number of positions of the coupling element 12.

For the coupling element 12 being in the closing state FIGS. 2*a, b* and *c* in sequence show a normal actuation of the pawl actuation lever 5, which actuation movement is far below the above noted rapidity threshold. Moving from the state shown in FIG. 2*a* to the state shown in FIG. 2*b* the pawl actuation lever 5 with its engagement surface 5*a* comes into engagement with the coupling element 12, which itself comes into engagement with an engagement surface 7*a* of the pawl release lever 7. In the state shown in FIG. 2*b* a force fit has built up between the pawl actuation lever 5 and the pawl release lever 7 via the coupling element 12. During further actuation of the pawl actuation lever 5 shown in FIG. 2*c* the pawl release lever 7 and with it the pawl 3 follow the movement of the pawl actuation lever 5. As a result the movement of the pawl actuation lever 5 leads to deflecting the pawl 3 into its release position.

It may be taken from FIG. 2*a* that moving the coupling element 12 into the opening state shown in dashed line leads to the pawl actuation lever 5 running free without deflecting the pawl 3 into its release state. The above noted opening state of the coupling element 12 is presently not only relevant for the proposed crash function, but also for realizing functional states "locked" and "unlocked" as will be explained later.

The realization of the switchable coupling arrangement 6 with a coupling element 12 which is a wire or a strip is particularly preferred, especially if the coupling element 12 is realized as a resiliently elastically bendable wire or strip, which can by its bendability be moved into the above noted closing state and opening state. Regarding possible embodiments of the switchable coupling arrangement 6 with a coupling element 12 which is designed as a resiliently elastically bendable wire or strip, reference may be made to US 2011/0084505 A1 which goes back on the applicant and which is hereby incorporated by reference.

As noted above the switching element 9 is engageable with the coupling element 12. It is also possible that the switching element 9 is always engaged with the coupling element 12. In order to reduce the number of components it may be also advantageous to design the switching element 9 itself as the coupling element 12.

It has been noted above that in the shown and preferred embodiment the first coupling lever 10 is the pawl actuation lever 5 and that the second coupling lever 11 is the pawl release lever 7 connected to the pawl 3 or the pawl 3 itself. Depending on the application, however, it may be preferably to design the first coupling lever 10 and/or the second coupling lever 11 as an additional lever or additional levers.

The drawings show that the switching element 9 is arranged and moveable on one of the two coupling levers 10, 11, here and preferably on the pawl actuation lever 5. In order to keep the costs for guiding the switching element 9 as low as possible it is proposed to arrange the switching element 9 on the pawl actuation lever 5 in a pivoting manner. Accordingly, the switching element 9 is preferably pivotable around a switching element axis 9*a*.

The sequence of FIGS. 3*a, b* and *c* shows the actuation movement of the pawl actuation lever 5 surpassing the rapidity threshold, such that an inertial characteristic of the switching element 9 causes the switchable coupling arrangement 6, if not already in the opening state, to switch into the opening state such that the pawl actuation lever 5 runs free without deflecting the pawl 3 into its release state. It is of major importance here that it is the inertial characteristic of the switching element 9 that causes the proposed switching of the switchable coupling arrangement 6.

In this context, an inertial characteristic may refer to the inertial mass of the switching element 9, the moment of inertia of the switching element 9 or to both quantities. It may also, in addition or alternatively, refer to the center of mass of the switching element 9. Likewise, the rapidity threshold may be defined in terms of the speed or velocity of the actuation movement, in terms of the acceleration of the actuation movement or may in fact involve both quantities.

Now starting from the switching element 9 being in the closing switching state (FIG. 2*a*) an inertial characteristic of the switching element 9 causes a switching movement of the switching element 9 into the opening switching state (FIG. 3*c*) when the actuation movement surpasses a rapidity threshold.

One interesting aspect regarding the shown embodiment is that the switching element 9 is sliding along and being supported by a support contour 13 such that the movement of the switching element 9 during actuation of the pawl actuation lever 5 below a rapidity threshold is defined by the support contour 13, holding the switching element 9 in its closing switching state as is shown in FIG. 2. In order to guarantee a robust engagement between the switching element 9 and the support contour 13 it is preferred that the switching element 9 is spring biased onto the support contour 13. For the engagement between the switching element 9 and the support contour 13 the switching element 9 comprises an engagement element 9*b* designed as a bolt that is sliding along the support contour 13.

The sequence of FIGS. 2*a* and 3*a* shows the beginning of an actuation movement of the pawl actuation lever 5 surpassing the rapidity threshold such that the switching element 9, caused by its inertial characteristic, leaves the support contour 13. FIG. 3*a* shows that the support contour 13 comprises a curved section 13*a* and that the switching element 9 cannot follow the actuation movement of the pawl actuation lever 5 without leaving the support contour 13 due to its mass inertia. In the preferred embodiment shown in the drawings this leaving of the support contour 13 by the switching element 9 does not have a direct impact on the coupling element 12.

The above noted, direct impact on the coupling element 12 is caused by a second contour 14, namely a switching contour 14. When the actuation movement surpasses the rapidity threshold the switching element 9, again caused by its inertial characteristics, comes into sliding engagement with the switching contour 14 which engagement causes, during further actuation of the pawl actuation lever 5, deflecting the switching element 9 further into the direction of its opening switching state, as is shown in FIG. 3*c*. The advantage of this second contour 14 is the fact that this second contour 14 converts the actuation movement of the pawl actuation lever 5 directly into a movement of the switching element 9 into its opening switching state.

The above noted movement of the switching element 9 into the opening switching state has an effect on the coupling element 12. In further detail the switching element 9 comprises an engagement surface 9*c* for the engagement with the coupling element 12. During the movement of the switching element 9 into its opening switching state the engagement surface 9*c* comes into engagement with the coupling element 12 and presses the coupling element downwards in FIG. 3. This is nothing else but moving the coupling element 12 into its open state such that the engagement surface 5*a* of the pawl actuation lever 5 comes out of engagement and/or stays out of engagement from the coupling element 12.

It may be pointed out that the switching element 9 here and preferably is a two-armed lever, wherein the bolt 9*a* is located on one arm and the engagement surface 9*c* is located on the other arm. Both arms of the switching element 9 are extending basically in opposite directions in the shown embodiment.

A very compact arrangement may be achieved, as shown in the drawings, if the pivot axis 3*a* of the pawl 3 is identical to the pivot axis of the pawl actuation lever 5.

In a further preferred embodiment a lock mechanism 15 is provided, which may be brought into different functional states such as "unlocked" and "locked" via a lock actuation arrangement 16 indicated in FIG. 2*a*. Those functional states are useful during normal operation, in particular when a door handle, which is connected to the pawl actuation lever 5, shall be enabled or disabled regarding deflecting of the pawl 3. The lock mechanism 15 with its lock actuation arrangement 16 acts on the switchable coupling arrangement 6 for realizing the functional states "unlocked" and "locked" such that the switchable coupling arrangement 6 closes in the functional state "unlocked" and opens in the functional state "locked". It may be seen in FIG. 2*a* that to realize the functional state "locked" the lock actuation arrangement 16 has to hold the coupling element 12 in the position shown in FIG. 2*a* in dashed lines without interfering with the movement of the pawl actuation lever 5. For realizing the functional state "unlocked" the lock actuation arrangement 16 simply has to be removed from the position indicated in FIG. 2*a*. With this simple arrangement not only the above noted crash function, but also a locking/unlocking function may be realized.

Finally it may be pointed out that the proposed solution is not only applicable to a motor vehicle lock 1 that is actuated manually by actuating a door handle. In the case that the pawl actuation lever 5 is drivable by a motor drive, a crash induced actuation of the pawl actuation lever 5 with high rapidity accordingly leads to the pawl actuation lever 5 running free as noted above.

The invention claimed is:

1. A motor vehicle lock for a motor vehicle door arrangement, comprising:

a catch, a pawl, which is assigned to the catch, a pawl actuation lever, and a switchable coupling arrangement between the pawl actuation lever and the pawl;

wherein the catch can be brought into an open position and into a closed position;

wherein the catch is or may be brought into holding engagement with a lock striker in the closed position;

wherein the pawl may be brought into an engagement position, in which the pawl is in blocking engagement with the catch;

wherein the pawl may be deflected into a release position, in which the pawl releases the catch;

wherein the pawl actuation lever is configured to perform an actuation movement in a deflection direction to deflect the pawl into the release position;

wherein the switchable coupling arrangement may be brought into a closing state and into an opening state;

wherein the switchable coupling arrangement comprises a moveable switching element that may be moved into a closing switching state such that the switchable coupling arrangement is in the closing state and into an opening switching state such that the switchable coupling arrangement is in the opening state;

wherein an inertial characteristic of the moveable switching element causes the switchable coupling arrangement, if not already in the opening state, to switch into the opening state in response to the actuation movement of the pawl actuation lever surpassing a rapidity threshold, such that the pawl actuation lever runs free without deflecting the pawl into the release state of the pawl;

wherein the moveable switching element is sliding along and supported by a support contour such that the movement of the moveable switching element during the actuation of the pawl actuation lever below the rapidity threshold is defined by the support contour, holding the moveable switching element in the closing switching state of the moveable switching element; and wherein when the actuation movement of the pawl actuation lever surpasses the rapidity threshold, the moveable switching element, caused by the inertial characteristic of the moveable switching element, comes into sliding engagement with a switching contour which engagement causes, during further actuation movement of the pawl actuation lever, deflecting the moveable switching element further into the direction of the opening switching state of the moveable switching element.

2. The motor vehicle lock according to claim 1, wherein the switchable coupling arrangement comprises a first coupling lever, a second coupling lever and a moveable coupling element that may be moved into the closing switching state for coupling engagement with the first coupling lever and the second coupling lever and into the opening switching state for decoupling the first coupling lever and the second coupling lever.

3. The motor vehicle lock according to claim 2, wherein the moveable switching element is engaged or engageable with the moveable coupling element.

4. The motor vehicle lock according to claim 2, wherein the first coupling lever is the pawl actuation lever and wherein the second coupling lever is one of a pawl release lever connected to the pawl and the pawl.

5. The motor vehicle lock according to claim 2, wherein the moveable switching element is arranged and moveable on one of the first coupling lever and the second coupling lever.

6. The motor vehicle lock according to claim 1, wherein the moveable switching element is arranged and moveable on the pawl actuation lever.

7. The motor vehicle lock according to claim 1, wherein when the actuation movement of the pawl actuation lever surpasses the rapidity threshold an inertial characteristic of the moveable switching element causes the switchable coupling arrangement, if not already in the opening state, to switch into the opening state such that the pawl actuation lever runs free without deflecting the pawl into the release state of the pawl.

8. The motor vehicle lock according to claim 1, wherein starting off from the moveable switching element being in the closing switching state an inertial characteristic of the moveable switching element causes a switching movement of the moveable switching element into the opening switching state when the actuation movement of the pawl actuation lever surpasses the rapidity threshold.

9. The motor vehicle lock according to claim 1, wherein the moveable switching element is spring biased onto the support contour.

10. The motor vehicle lock according to claim 1, wherein when the actuation movement of the pawl actuation lever surpasses the rapidity threshold the moveable switching element, caused by the inertial characteristic of the moveable switching element, leaves the support contour.

11. The motor vehicle lock according to claim 1, wherein when the actuation movement of the pawl actuation lever surpasses the rapidity threshold, the moveable switching element leaves the support contour and, during further actuation movement of the pawl actuation lever, comes into initial engagement with the switching contour, which initial engagement deflects the moveable switching element into the opening switching state of the moveable switching element.

12. The motor vehicle lock according to claim 1, wherein a lock mechanism is provided, which may be brought into different functional states including "unlocked" and "locked" via a lock actuation arrangement and wherein the lock mechanism acts on the switchable coupling arrangement for realizing the functional states "unlocked" and "locked" such that in the functional state "unlocked" the switchable coupling arrangement is in the closing state and in the functional state "locked" the switchable coupling arrangement is in the opening state.

* * * * *